US009132300B2

(12) United States Patent
Moore

(10) Patent No.: US 9,132,300 B2
(45) Date of Patent: Sep. 15, 2015

(54) NASAL FILTER STRUCTURE

(76) Inventor: Joseph K. Moore, New Port Richey, FL (US)

( * ) Notice: Subject to any disclaimer, the term of this patent is extended or adjusted under 35 U.S.C. 154(b) by 455 days.

(21) Appl. No.: 13/456,129

(22) Filed: Apr. 25, 2012

(65) Prior Publication Data

US 2012/0279504 A1 Nov. 8, 2012

Related U.S. Application Data

(60) Provisional application No. 61/482,275, filed on May 4, 2011.

(51) Int. Cl.

| | |
|---|---|
| ***A62B 23/06*** | (2006.01) |
| ***A62B 7/10*** | (2006.01) |
| ***A41D 13/11*** | (2006.01) |

(52) U.S. Cl.

CPC ..... *A62B 23/06* (2013.01); *A41D 13/11* (2013.01); *A62B 7/10* (2013.01)

(58) Field of Classification Search

CPC ..... A62B 23/06; A62B 7/10; A62B 23/025; A62B 18/02; A62B 18/08; A62B 23/00; A62B 23/02; A62B 7/00; A61M 16/106; A61M 16/0688; A61M 16/0866; A61M 16/208; A61M 15/0028; A61M 15/08; A61M 15/085; A61M 15/0011; A61M 15/0031; A61M 15/0048; A61M 15/00; A61M 16/00; A41D 13/1176; A41D 13/05; A41D 13/11; A61L 9/12; B65B 51/023; B65B 51/00; B65B 51/02; B65B 9/00; B65B 9/04; B65B 9/042; A61F 5/08; A61B 19/00; A61G 10/00; B01D 39/2041; B01D 39/2072; B29C 65/00; B32B 33/00; B32B 37/00; B32B 38/04; B32B 9/00

USPC ..... 128/200.24, 205.27, 205.29, 206.11, 128/206.16, 206.18, 206.19, 206.14, 128/203.12, 203.15, 848, 858; 606/199–204; 602/41–59, DIG. 24, 602/189; 55/DIG. 35, 385.1, 385.2, 524

See application file for complete search history.

(56) References Cited

U.S. PATENT DOCUMENTS

| | | | | |
|---|---|---|---|---|
| 1,914,418 | A | 6/1933 | Goyena | |
| 4,955,945 | A * | 9/1990 | Weick | 128/203.12 |
| 5,890,491 | A | 4/1999 | Rimkus | |
| 8,550,079 | B2 * | 10/2013 | Moore | 128/205.29 |

(Continued)

FOREIGN PATENT DOCUMENTS

| | | | |
|---|---|---|---|
| CN | 1729029 | A | 2/2006 |
| CN | 101330946 | A | 12/2008 |

OTHER PUBLICATIONS

International Search Report and Written Opinion of the International Searching Authority mailed Aug. 6, 2012 received in PCT/US12/35048 (11 pgs.).

(Continued)

*Primary Examiner* — Annette Dixon

(74) *Attorney, Agent, or Firm* — Brian J. Colandreo; Jeffrey T. Placker; Holland & Knight LLP

(57) ABSTRACT

A nasal filter structure includes an artificial filter that inconspicuously covers the nasal passage with a screened nasal dilator. The structure includes a nasal dilation strip preferably positioned to affect the area of nasal flex points to aid in dilating a nasal passage in an area near a nasal flex point.

9 Claims, 7 Drawing Sheets

(56) References Cited

U.S. PATENT DOCUMENTS

| | | | | |
|---|---|---|---|---|
| 2008/0099021 | A1* | 5/2008 | Moore | 128/206.11 |
| 2008/0216838 | A1 | 9/2008 | Wondka | |
| 2009/0188493 | A1* | 7/2009 | Doshi et al. | 128/200.24 |

OTHER PUBLICATIONS

International Preliminary Report on Patentability for International Application No. PCT/US2012/035048 mailed Nov. 14, 2013.

Technical Data Sheet PS-1006 published by Polymer Science, Inc. Monticello, Indiana, Sep. 30, 2010.

Technical Data Sheet PS-1010 published by Polymer Science, Inc. Monticello, Indiana, Sep. 30, 2010.

Technical Data Sheet PS-1025 published by Polymer Science, Inc. Monticello, Indiana, Sep. 30, 2010.

Technical Data Sheet PS-1034 published by Polymer Science, Inc. Monticello, Indiana, Sep. 30, 2010.

First Office Action in related CN Application No. 2012800217883, issued Feb. 16, 2015, 6 pages.

* cited by examiner

NASAL FILTER STRUCTURE

CROSS REFERENCE TO RELATED APPLICATION

This application claims the benefit of U.S. Provisional Application No. 61/482,275 filed May 4, 2011, the disclosure of which is hereby incorporated by reference.

TECHNICAL FIELD

The present disclosure generally relates to a nasal filter structure with a screened nasal dilator.

BACKGROUND OF THE DISCLOSURE

An object of the disclosure is to provide a respiratory nasal filter that is esthetically pleasing to wear.

Another object of the disclosure is to provide a respiratory nasal filter that is extends across a users' nostril.

SUMMARY OF THE DISCLOSURE

According to a first implementation, a nasal filter structure comprises an outer ring having an outer periphery and an inner periphery sized to the periphery of a user's nasal orifice; a filter layer having an outer periphery larger than the inner periphery of the outer ring, but smaller than the outer periphery of the outer ring, and being bonded to a side of the outer ring; an adhesive on an opposite side of the outer ring for bonding the outer ring to the columella, a nasal sill, an alar sidewall and the facet of the user's nose; an additional adhesive at opposing locations of the adhesive and positioned to bond to natural flex points of the user's nose; and a dilator positioned between the additional adhesive. In other implementations, a nasal filter structure in accordance with the disclosure includes an outer filter layer positioned over the filter layer.

The details of one or more implementations are set forth in the accompanying drawings and the description below. Other features will become apparent from the description, the drawings, and the claims.

DETAILED DESCRIPTION OF PREFERRED EMBODIMENTS

Figure 1:
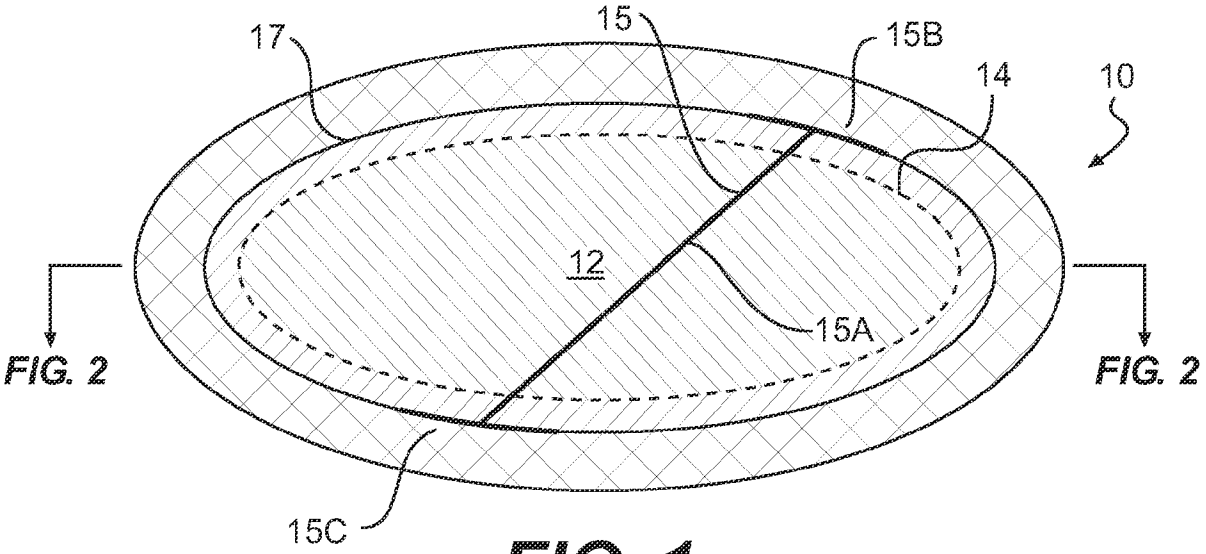
FIG. 1 is a schematic view an embodiment of a nasal filter structure in accordance with the present disclosure.
Figure 2:
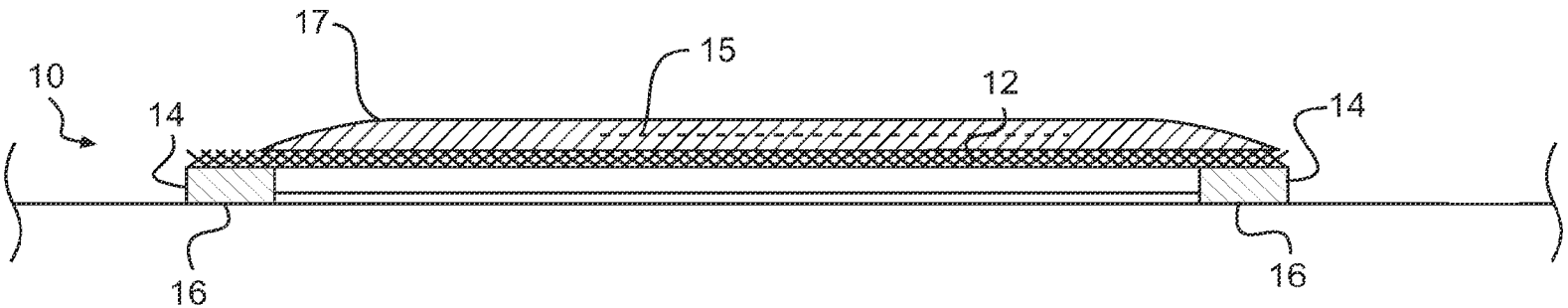
FIG. 2 is a cut-away view of the FIG. 1 structure.

FIG. 1 is a schematic view an embodiment of a nasal filter structure in accordance with the disclosure. Referring to FIG. 1 a nasal filter 10 comprises a generally oval-shaped configuration dimensioned to be slightly larger than the usual size of the periphery of a person's nasal orifice, namely a person's nostril. FIG. 2 is a cut-away view of the FIG. 1 structure. In FIG. 2, the nasal filter 10 comprises a filter layer 12 that includes a microporous filter material. The microporous filter material of the filter layer 12 can comprise a moisture resistant filter material with sufficient pore size to filter out the unwanted particulate, bacteria or virus.

In an embodiment of the disclosure, the microporous filter can be, for example, a nonwoven spunlaced polyester fabric. An example of a nonwoven fabric is PS-1025 available form Polymer Science, Inc. of 2787 S. Freeman Rd., Monticello, Ind. 47960, the technical disclosure of which is hereby incorporated by reference. The PS-1025 is a ¾ ounce beige colored apertured spunlaced polyester fabric, with a total thickness of 0.003 inches. As would be appreciated by a person skilled in the art, various color nonwoven fabrics could be utilized so as to match the color of nasal filter as closely as possible to the color and hue of the user's skin, further diminishing the visibility of the nasal filter when worn. Similarly, transparent nonwoven fabrics could be utilized, which would also reduce the visibility of the nostril filter when worn. This fabric is comfortable while also mechanically stable allowing the fabric to be used effectively in the nasal filter disclosed herein. The filter 12 is also preferably designed to be up to 99% percent effective at screening particulate matter and other matter such as respiratory droplets and carcinogens.

The placement of a nasal filter structure in accordance with the disclosure in the nasal passage allows the structure to be automatically flush when the wearer exhales. Thus, the nasal filter structure in accordance with the disclosure is self-cleaning for long periods of use or during long work periods. This effect is also increased by the proximity of the screen placement to the nasal passage by the outer ring.

The filter layer 12 is adhered in a fixed manner to the upper surface of an oval ring-shaped base layer 14, preferably comprising a clear plastic material. An adhesive 16 is applied to the underside of the base layer 14. Adhesive 16 is designed to securely adhere to the peripheral edge of the person's nostril, yet is removable when desired. The ring-shaped base layer 14 may comprise an appropriate size and configuration that fits a traditional nostril size such that it only adheres to the peripheral edge of the nostril.

In a preferred embodiment of the present disclosure, the filter layer 12 and ring-shaped base layer 14 are flexible. Flexibility allows the nasal filter to completely seal a nostril. In a preferred embodiment of the present disclosure, the ring-shaped base layer 14 is preferably no more than 1/16 of an inch wide, and preferably as small as 1/32 of an inch wide. This minimal size combined with the flexibility of the material is sufficient to firmly attach the nostril filter 10 to the user's nostril, regardless of the shape and size of the respective nostril.

Figure 3:
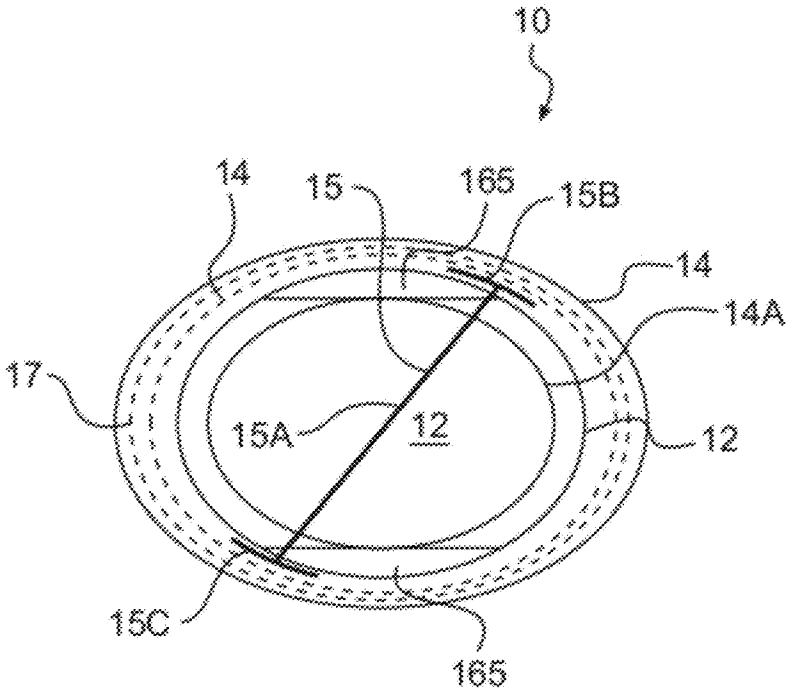
FIG. 3 is a schematic view of an embodiment of a nasal filter structure in accordance with the disclosure.

Referring to FIGS. 1-3, a nasal filter of an embodiment of a nasal filter structure in accordance with the disclosure can include a secondary outer filter layer 17. The secondary outer filter layer may be applied in addition to the filter layer 12. The secondary outer filter layer 17 can have a lesser filtering efficiency. In an exemplary embodiment of the disclosure, the secondary outer filter layer 17 can comprise a material such as PS-1025-2a provided by Polymer Science Inc., 2787 S. Freeman Rd., Monticello, Ind. 47960. With this exemplary material, smaller partials pass through the secondary outer filter layer 17 to the filter layer 12. In an embodiment of the disclosure, the secondary outer filter layer 17 can be sprayed, such as an outer surface thereof, with a very light adhesive. An example adhesive is PS-1034A available from Polymer Science Inc., 2787 S. Freeman Rd., Monticello, Ind. 47960. The light adhesive allows the secondary outer filter layer 17 to trap larger particles that can be subsequently examined under microscope to determine what someone is being exposed to. With such a subsequent analysis of the material trapped by the filter, a person can be treated for what they are being exposed to and not what they are allergic. This may save billions of dollars and many lives as well especially effective for molds and particulate matter.

FIG. 3 is a schematic view of an embodiment of a nasal filter structure in accordance with the disclosure. Referring FIG. 3 an embodiment of the nasal filter 10 of the invention comprises a clear, oval ring-shaped base layer 14 with the adhesive 16 applied to the underside of the base layer 14. The filter layer 12 is formed in a smaller size relative to the clear base layer 14 and is affixed to the underside of the base layer 14, while secondary outer filter layer 17 has, in the illustrate exemplary embodiment is larger than the filter layer 12, but smaller than the base layer 14. As seen from FIG. 3, the base layer 14 slightly overlaps the peripheral edge of the filter layer 12 such that the filter layer 12 is adhered to its underside by the adhesive 16. However, the size of the base layer 14 is sufficiently large to define an adhesive area 14A on the base layer 14 beyond the periphery of the filter layer 12. The adhesive 16 thus functions to permanently adhere the filter layer 12 to its underside while also providing adhesive area 14A that removably adheres to the person's skin about the periphery of the person's nostrils.

It is noted that additional adhesiveness may be provided to the adhesive area 14A. More specifically, a stronger adhesive 165 may be applied to the inner portions of the filter layer 12 that overlap with the base layer 14. As shown, the stronger adhesive 165 may comprise spots of adhesive 165 that are applied to opposing sides of the overlapping of the filter layer 12 and base layer 14. In this regard, it is believed that only two spots are necessary to provide adequate adherence to the peripheral edge of the person's nostril.

Different strength adhesives can be utilized for different uses. For instances, industrial uses where high level of airborne contaminants are present benefit from stronger adhesives. These stronger adhesives securely maintain the seal around the user's nostril preventing contaminants from entering the user's nasal passage. A preferred industrial adhesive is a double coated medical grade acrylic pressure sensitive adhesive such as Polymer Science, Inc.'s PS-1006, the technical specifications of which are hereby incorporated by reference. Polymer Science, Inc.'s PS-1006 is a double coated high performance medical grade acrylic adhesive with a polyethylene carrier on a 54#C2S paper differential release liner. Adhesives such as the PS-1006 from Polymer Science, Inc. bond well to most porous and non-porous surfaces. Additionally, these adhesives have high initial tack, enabling immediate application to a user's nostril once the nasal filter is removed from its packaging. Similarly, these adhesives provide exceptional skin adhesion and leave no residue when removed from the skin.

Alternatively, for more recreational usages whereby the contaminant level is not so severe, a lighter weight adhesive suffices. A preferred recreational adhesive is a single coated medical grade acrylic pressure sensitive adhesive, such as Polymer Science, Inc.'s PS-1010, the technical specifications of which are hereby incorporated by reference. Polymer Science, Inc.'s PS-1010 is a single coated high performance medical grade acrylic adhesive with a polyethylene carrier on a 54#C2S paper differential release liner. Adhesives such as the PS-1010 from Polymer Science, Inc. bond well to most porous and non-porous surfaces. Additionally, these adhesives have high initial tack, enabling immediate application to a user's nostril once the nasal filter is removed from its packaging. Similarly, these adhesives provide exceptional skin adhesion and leave not residue when removed from the skin.

Figure 4:
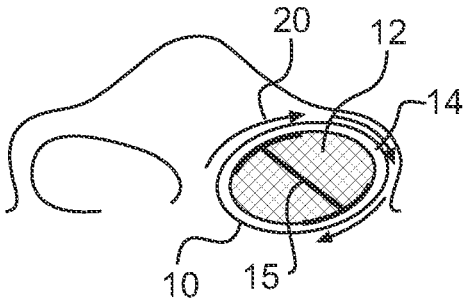
FIG. 4 illustrates an embodiment of a nasal filter structure in accordance with the disclosure positioned in a nasal passage.

Referring to FIGS. 1 and 3, a nasal filter structure in accordance with the disclosure can include a dilator 15. Preferably, the dilator 15 comprises a clear plastic so as to be inconspicuous. The dilator 15 can have a variety of different structures depending upon the application or cost target of the nasal filter structure. For example, it can be either a solid, a hinged locking, or a ratcheting piece of soft but firm plastic. In an exemplary embodiment of the disclosure the dilator 15 can comprise a central portion 15A and two curved portions 15B and 15C. The curved portions 15B and 15C are preferably curved to the shape of the curve of the nasal filter structure and the natural curve of the flex points of a nasal passage. The two curved portions 15B and 15C can also flex and shape to individual nasal passage shape and are connected by a center extension 15A extending across the center of the nasal passage as shown in, for example, FIG. 4. The dilator 15 creates a rigid center to tighten the nasal filter structure and expand the nasal passage wider than normal to increase breathability. In preferred embodiments, the center extension 15A can be solid, ratcheting, or include a center self-locking hinge assembly that locks or snaps in place. The center extension 15A will also prevent nasal screen from being inhaled or accidentally inserted. FIG. 4 illustrates an embodiment of a nasal filter structure in accordance with the disclosure positioned in a nasal passage. As shown in FIG. 4, the dilator 15 extends between nasal flex points to aid in opening the nasal passage. In an illustrative embodiment, the two curved portions 15B and 15C can be sandwiched between both seals and under (e.g., directly) the nasal passage half-moon shaped inner seal 165 shown in FIG. 3. This design and placement helps provide extra support and helps with proper placement of the dilator 15 at a flex point of a nose.

Figure 5A:
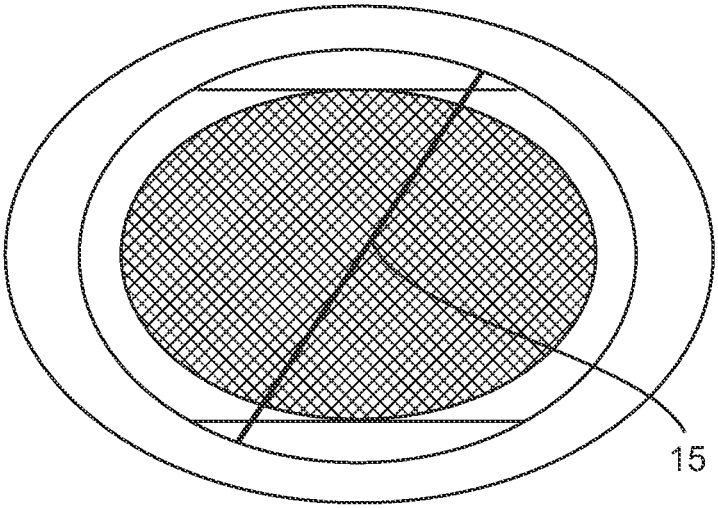
FIGS. 5A and 5B illustrate a nasal filter structure in accordance with the disclosure including a dilator.
Figure 5B:
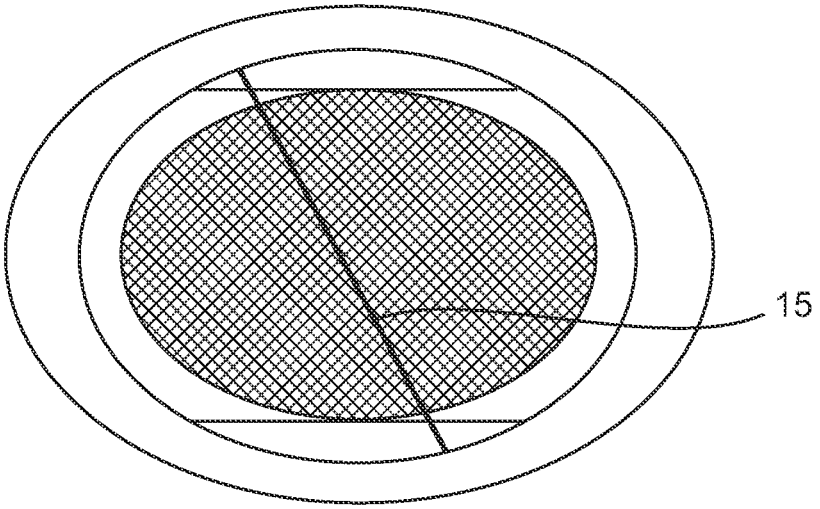

The dilator 15 does not necessarily need to be used with curved portions 15B and 15C. In an embodiment of the nasal filter structure such as shown in FIGS. 5A and 5B, the dilator 15 can be used in a nasal filter structure in accordance with the disclosure without the curved portions 15B and 15C. In this embodiment, the dilator 15 aids in tightening the filter media, e.g., filter layer 12 and secondary outer filter layer 17 if it is used.

Figure 6C:
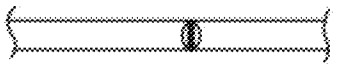
FIGS. 6A, 6B and 6C illustrate an embodiment of a dilator in accordance with the disclosure.
Figure 6B:
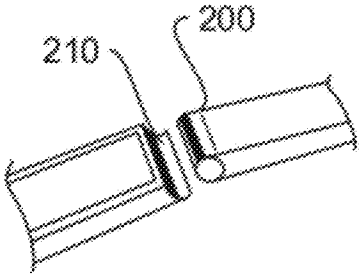
Figure 6A:
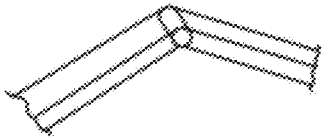

FIGS. 6A, 6B and 6C illustrate an embodiment of a dilator center extension 15A in accordance with the disclosure. FIGS. 6A, 6B, and 6C illustrate a locking mechanism. In the illustrative embodiment of FIGS. 6A, 6B, and 6C, the locking mechanism includes a hinged locking mechanism, which can be a cylinder locking mechanism. Referring to FIG. 6B, the center extension 15A includes a flexible cylinder locking mechanism comprises a cylinder 200 and a complementary curved portion 210. The cylinder 200 snaps into or is press fit into the complementary curved portion 210. In an exemplary embodiment, the cylinder 200 and complementary curved portion 210 each have a latch portion. In one exemplary embodiment a latch portion can comprise a concave portion on either the cylinder 200 or the complementary curved portion 210, and a protruding portion on the other of the cylinder 200 or complementary curved portion 210. The corresponding latch portions latch when the flexible cylinder locking mechanism is in the locked position such as shown in FIG. 6C. FIG. 6A illustrates the flexible cylinder locking mechanism in a relaxed, non-latched position. For example, with the illustrative exemplary latch portion mentioned above, when the flexible cylinder locking mechanism is in the locked position, the protrusion portion engages the concave portion to tend to hold the structure in place via, for example a dimple and detent type action.

Figure 7:
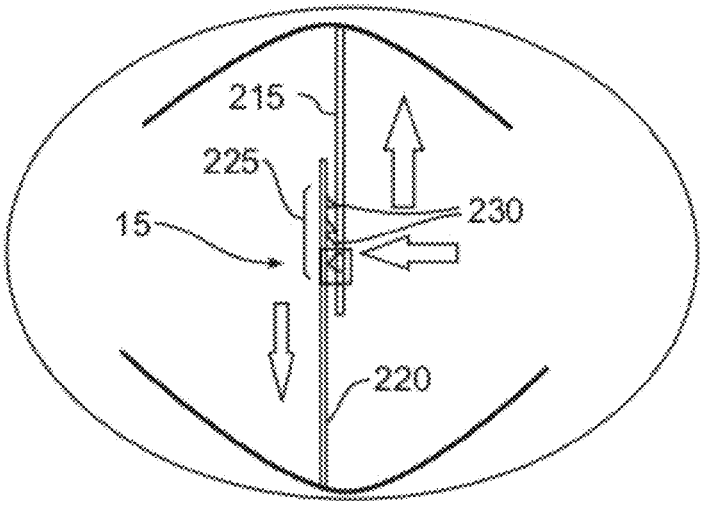
FIG. 7 illustrates an embodiment of a dilator in accordance with the disclosure.

FIG. 7 illustrates an embodiment of a dilator in accordance with the disclosure, including a locking mechanism. In the illustrative embodiment of FIG. 7, the locking mechanism includes a ratchet mechanism. Referring to FIG. 7, the dilator 15 includes two opposing arms, 215 and 220. The opposing arms are joined by a ratcheting mechanism 225. When pressured is applied along the length of the dilator 15, the clips 230 within the ratcheting mechanism 225 lock. The ratcheting mechanism 225 allows the wearer to adjust how much extension, and therefore how much dilation is applied to a nasal passage. In one example, the ratcheting mechanism 225 can provide $1/8^{th}$ inch extension per clip 230. Depending upon the dimensions of the dilator and the amount of extension desired, air flow can be increased up to 100%.

Figure 8A:
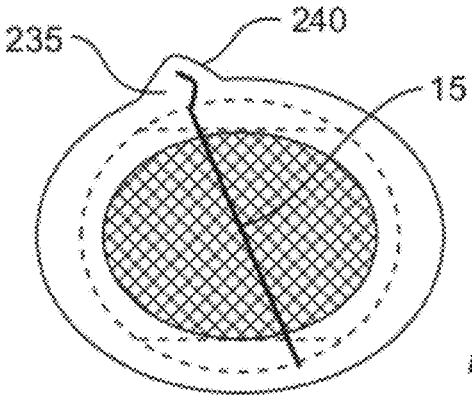
FIGS. 8A and 8B illustrate an embodiment of a dilator in accordance with the disclosure.
Figure 8B:
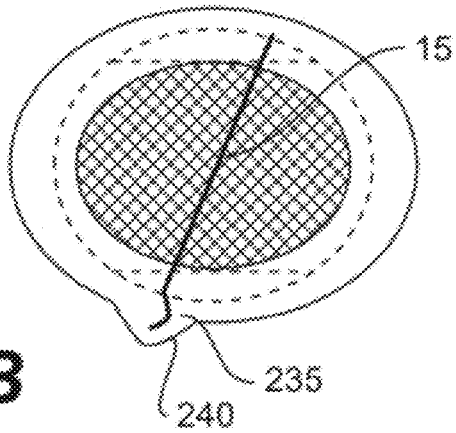

FIGS. 8A and 8B illustrate an embodiment of a dilator in accordance with the disclosure. Referring to FIGS. 8A and 8B, the dilator 15 includes a secondary extension 235. The secondary extension 235 extends onto an extension 240 of, for example the layer 14. This structure allows the extension 235 and 240 to conform around the natural curve of the flared portion of a nasal passage. The secondary extension 235 creates a slight outward pull. Such a slight outward pull tends to improve the users breathing ability and increase air flow. In a preferred embodiment, the secondary extension 235 can be covered by a curved tab of clear adhesive to remain inconspicuous as shown in FIGS. 8A and 8B.

In the illustrative embodiments mentioned above, applying an outward force to the nasal filter structure causes the two sides of the dilator 15 to stretch away from one another. The action causes the locking mechanism to close (e.g., snap close). This allows the dilator to open the nasal passage and allows the user to breath a greater volume of air compared to not using a nasal filter structure in accordance with the disclosure.

Figure 9:
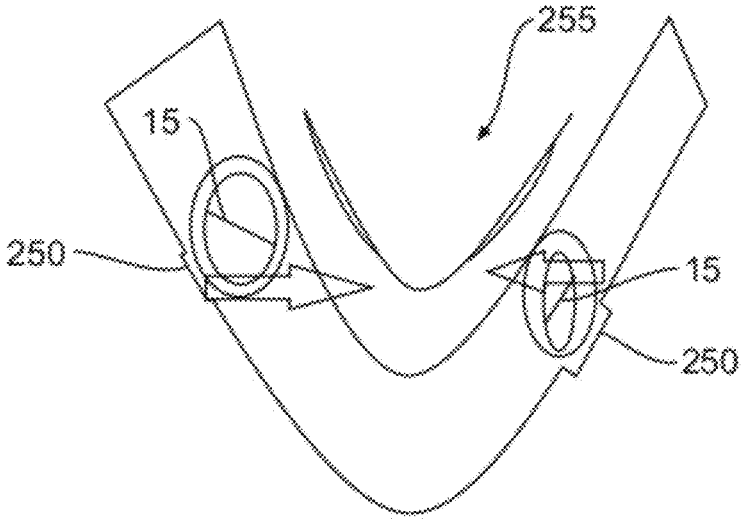
FIG. 9 illustrates an embodiment of a nasal filter structure in accordance with the disclosure.

FIG. 9 illustrates an embodiment of a nasal filter structure in accordance with the disclosure. Referring to FIG. 9, a nasal filter structure in accordance with the disclosure can include tabs 250. The tabs 250 aid in positioning the nasal filter structure with the user's nose 255. This aids in properly positioning the nasal filter structure as a whole and in particular the dilator 15.

Figure 10:
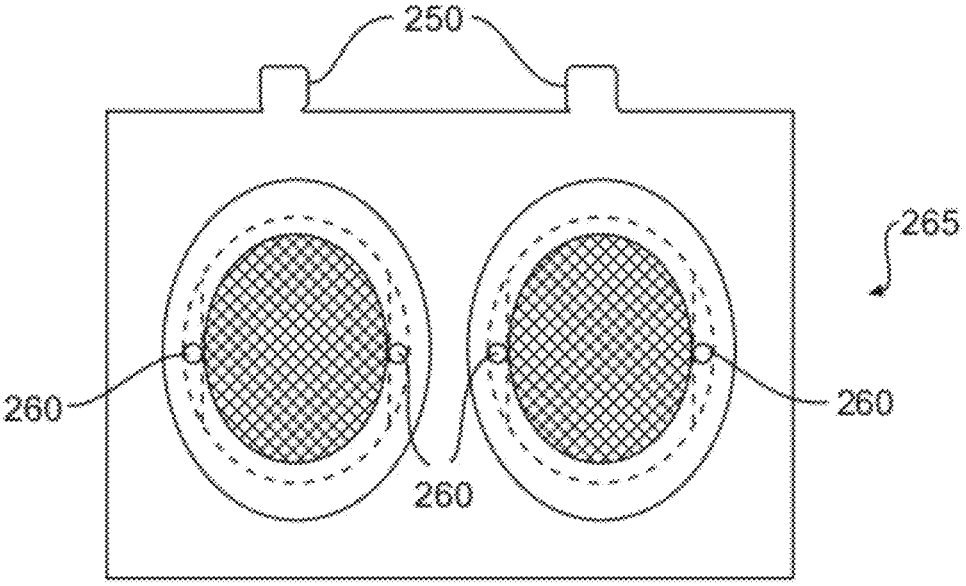
FIG. 10 illustrates a nasal filter structure in accordance with the disclosure on an applicator.

FIG. 10 illustrates a nasal filter structure in accordance with the disclosure on an applicator 265. Referring to FIG. 10, the applicator 265 includes the tabs 250 mentioned above. Each nasal filter structure is positioned upside down on the applicator 265 and held in position with easy release adhesive 260. The easy release adhesive allows the nasal filter structures to be held in place on the applicator 265, while allowing the applicator 265 to be easily pealed away from the nasal filter structure when in position, using, for example the tabs 250 to assist in positioning the nasal filter structure on a user's nose. The use of the applicator also avoids the user touching the nasal filter structure during application, reducing the risk of unnecessary contamination. As noted above, the tabs 250, when placed at the tip of a nasal passage on either side of a nose will automatically apposition the nasal filter structure. This allows easy application regardless of the direction of the nasal passage.

Figure 11:
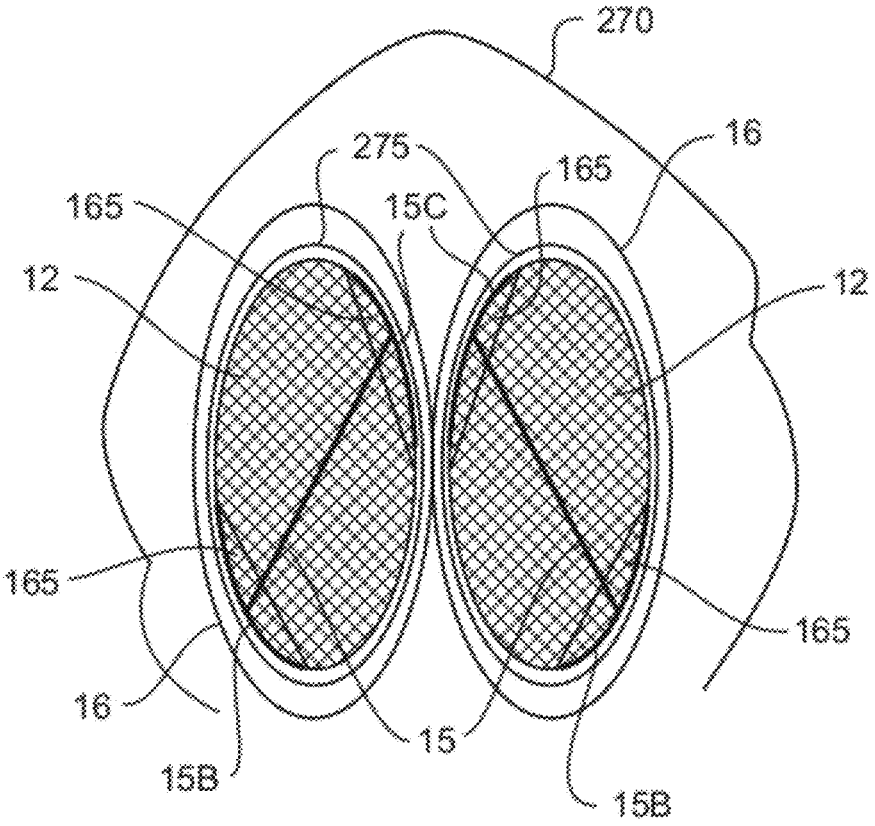
FIG. 11 schematically illustrates a nasal filter structure in accordance with the disclosure positioned on a nose.

FIG. 11 schematically illustrates a nasal filter structure in accordance with the disclosure positioned on a person's nose 270. Referring to FIG. 11, an outer clear seal 16 conforms to the shape of the nasal passage 275. In the illustrated embodiment, the curved portions 15B, 15C of the dilator 15 are positioned in the area of the half moon portions 165, which in the illustrated embodiment correspond to a natural flex point of the user's nose 270.

Having thus described illustrative embodiments of the invention of the disclosure in detail and by reference to embodiments thereof, it will be apparent that modifications and variations are possible without departing from the scope of the invention defined in the appended claims.

What is claimed is:

1. A nasal filter comprising:

an outer ring having an outer periphery and an inner periphery sized to the periphery of a user's nasal orifice;

a filter layer having an outer periphery larger than the inner periphery of the outer ring, but smaller than the outer periphery of the outer ring, and being bonded to a side of the outer ring;

an adhesive on an opposite side of the outer ring for bonding the outer ring to the columella, a nasal sill, an alar sidewall and the facet of the user's nose;

an additional adhesive at opposing locations of the adhesive and positioned to bond to natural flex points of the user's nose; and a dilator positioned between the additional adhesive to open a nasal passage, wherein the dilator includes a plurality of curved portions to fit a structure of the nasal filter and to fit the natural flex points of the user's nose.

2. A nasal filter according to claim 1, further comprising:

an outer filter layer positioned over the filter layer.

3. A nasal filter according to claim 2, wherein the outer filter layer comprises a nonwoven material.

4. A nasal filter according to claim 1, wherein the filter layer comprises a nonwoven material.

5. A nasal filter according to claim 1, wherein the dilator includes curved portions at distal ends thereof.

6. A nasal filter according to claim 1, wherein the dilator includes a locking mechanism.

7. A nasal filter according to claim 6, wherein the locking mechanism includes a hinged locking mechanism.

8. A nasal filter according to claim 7, wherein the locking mechanism includes a cylinder locking mechanism.

9. A nasal filter according to claim 6, wherein the locking mechanism includes a ratchet locking mechanism.

* * * * *